United States Patent [19]

Kunz

[11] Patent Number: 4,766,830

[45] Date of Patent: Aug. 30, 1988

[54] BOAT, ESPECIALLY A CATAMARAN, WITH LARGE DECK SPACE AND COLLAPSIBLE FRAME

[76] Inventor: Daniel Kunz, 5903 Mount Eagle Dr., Alexandria, Va. 22303

[21] Appl. No.: 896,776

[22] Filed: Aug. 15, 1986

[51] Int. Cl.[4] ..... B63H 9/04

[52] U.S. Cl. ..... 114/61; 114/91; 114/127; 114/162; 114/169; 114/292; 114/345; 114/354

[58] Field of Search ..... 114/61, 56, 127, 292, 114/264, 266, 267, 343, 345, 354, 381, 89–91, 147 R, 162, 169, 39

[56] References Cited

U.S. PATENT DOCUMENTS

| | | | |
|---|---|---|---|
| 2,899,925 | 8/1959 | Meek | 114/61 |
| 3,473,502 | 10/1969 | Wittkamp | 114/345 |
| 3,608,112 | 9/1971 | Irgens | 114/345 |
| 3,812,805 | 5/1974 | Forssell | 114/345 |
| 3,866,557 | 2/1975 | Lang | 114/61 |
| 3,970,025 | 7/1976 | Sovia | 114/61 |
| 4,102,287 | 7/1978 | Ferris | 114/61 |
| 4,136,414 | 1/1979 | Popkin | 114/345 |
| 4,503,795 | 3/1985 | Krans | 114/61 |
| 4,543,898 | 10/1985 | Castilla | 114/61 |

*Primary Examiner*—Sherman D. Basinger
*Assistant Examiner*—Cifford T. Bartz
*Attorney, Agent, or Firm*—Jim Zegeer

[57] ABSTRACT

A boat, especially a catamaran, having a rectangular collapsible frame with a one-man mast stepping structure. The tubular frame is comprised of fore, aft and central sub-frame assemblies which can be collapsed so as to be easily car topable and serve as a rack for containing other components of the catamaran. Inflatable hulls are secured in bracket arches on the undersides of the sub-frame assemblies. A rudder frame or cage is pivotally mounted on an aft sub-frame assembly and is adapted to receive a rudder, which is identical to and interchangeable with daggerboards. A system of adjustable rope stays is provided for adjusting the mast.

23 Claims, 6 Drawing Sheets

FIG. 1
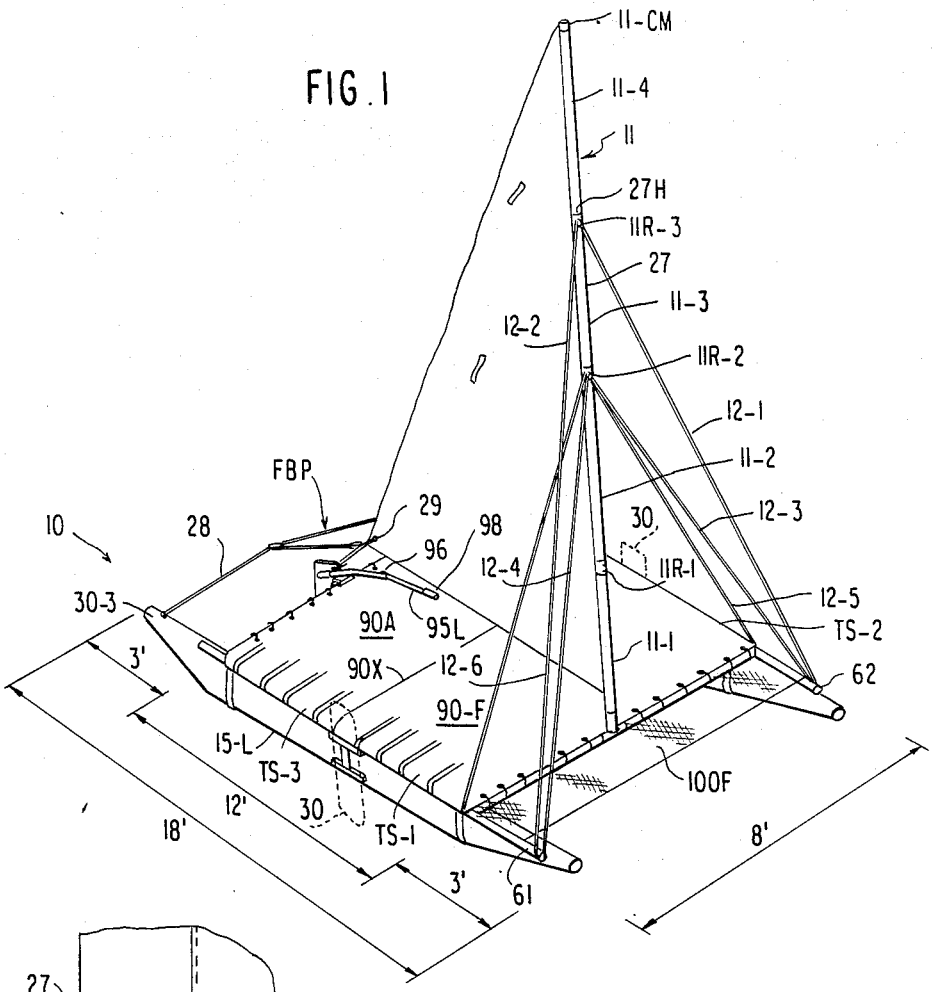
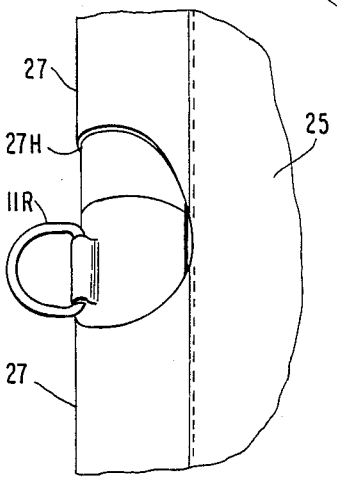
FIG. 2b
FIG. 2a
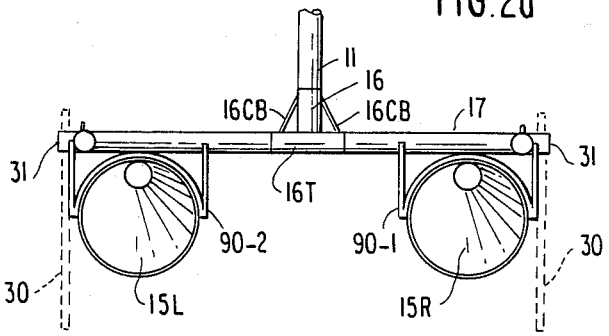

FIG. 4C
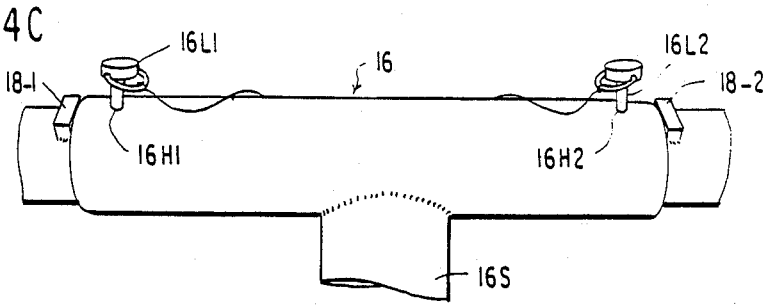
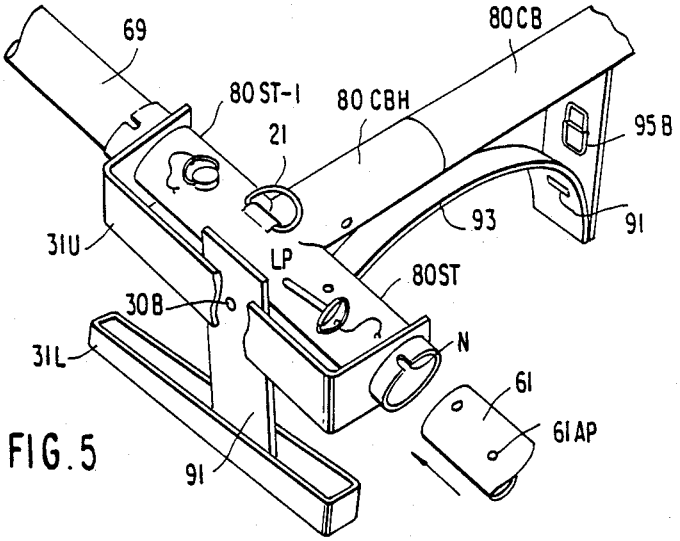
FIG. 5
FIG. 11
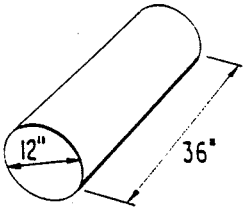
FIG. 6
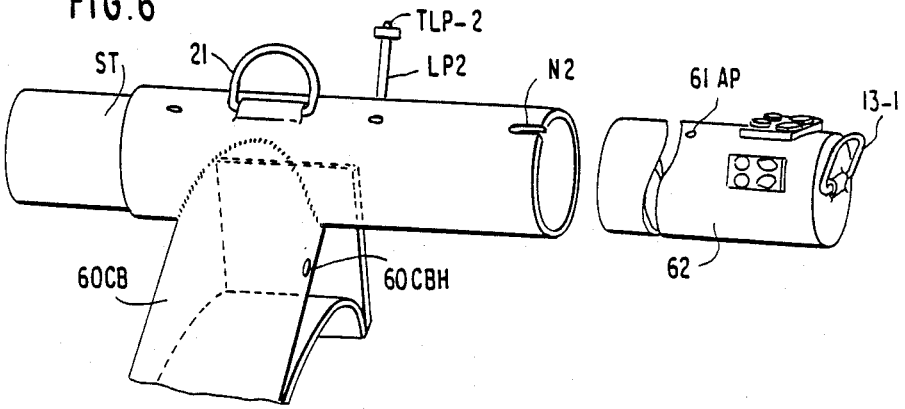

BOAT, ESPECIALLY A CATAMARAN, WITH LARGE DECK SPACE AND COLLAPSIBLE FRAME

BACKGROUND AND BRIEF DESCRIPTION OF THE INVENTION

The present invention is directed to improvements in boats, especially catamarans, more especially catamarans with inflatable hulls, which are easily transported to and from the water, can be conveniently stored at the home in a closet, for example, or out of way place in the garage and can be assembled by one person in one-half hour and easily hold 4 to 8 adults and can be sailed by relative novices. In a preferred embodiment the boat includes large usable deck space (typically 8×12 or 96 square feet). The boat is extremely stable for novice users and will sail well in light airs, has a relatively simple design specification so that fabrication coats are low and contemplates the use of off-shelf parts where possible. The boat, without mast and sail can be used as a dive platform, a sun deck in the water, or with a small motor it becomes a pontoon boat for lake or river use. In such configuration a tent, awning, or other type of shelter can be placed on it making a self contained water going camping facility. Each mast section may be filled with foam flotation. The mast is composed of a plurality of telescoping sections which preferably are simply extruded aluminum tubes which have an insert for joining two tubes together with attached sleeves for a tighter fit. The mast stays hold the tubing sections together. A simple mast stepping arrangement utilizes a T-shaped member which is rotatably received on a forward cross bar and receives the telescoping end of the mast which has a pin projection at the lower most end. A rectangular slot in the leg of the T receives a shear pin which passes through a hole in the lower end of the mast. The mast is stepped by pivotting the T-shaped member about a forward cross bar on the frame until the pin in the lower end of the mast slides into a tubular recess formed transversely in the forward cross beam at a predetermined angle, preferably 75 degrees, so that the mast is stepped at a 75 degree angle. A pair of pins is manually passed through a aligned holes in the T-shaped member and the forward cross bar to secure the mast in its stepped position. The mast can easily be lowered by reversing the procedure. The elongated slot allows the mast latching pin to slide therein when the lower pin at the lower end thereof slides into the tubular member in the forward cross bar.

The frame for supporting the trampoline includes fore and aft cross bar sub-frames and a central cross bar sub-frame. For smaller boats, one of the sub-frame assemblies may be eliminated. Longitudinally extending tubular members extend between the fore cross bar and central cross bar sub-frames and a second pair of longitudinally extending tubular members are telescopically received in the end sections of the sub-frames. Each sub-frame includes a cross bar and a laterally spaced pair of semi-circular hull encompassing or arched brackets secured beneath each cross bar and a pair of tubular end pieces for telescopically receiving the longitudinally extending tubular members respectively. The tubular end pieces are secured to the lateral ends of the cross bar and includes locating holes and an orienting slot for the longitudinally extending tubular member and the tubular pieces. It will be appreciated that the tubular end pieces can be cast as "T" shaped members identical to the "T" shaped mast stepping member as described later herein.

The inflatable hulls have sections which extend fore and aft of the rectangular frame so as to assure a smooth pass of the main hull portions into and through the water. A pair of daggerboards are adjustably secured to the central cross bar sub-frame at the lateral ends thereof and a single rudder is pivotally mounted in the center of the aft cross bar. The rudder assembly includes a frame which slidably receives a rudder which preferably is identical to each of the daggerboards so that should one daggerboard or rudder be lost, the catamaran is still sailable and can be safely returned because of the interchangeability of the rudder and daggerboard units. When the mast has been stepped, non-metallic rope stays are secured to the forward end of the longitudinally extending tubular members via rope guide and jam cleat assemblies.

The tubular end pieces on the central cross bar sub-frame are telescopically received on a pair of short tubes (or a pair of the longer longitudinal members may be used for this purpose) with the fore and aft sub-frame assembly being telescopically received pairs of short tubes and locked in position to constitute a collapsed frame so that this collapsed frame can then be inverted and mounted on the car top with three of the semi-circular hull encompassing brackets aligned transversely of the car to serve as a carrier for deflated hulls, trampoline, rudder and daggerboards and sail and other components of the boat.

BRIEF DESCRIPTION OF THE DRAWINGS

The above and other objects, advantages and features of the invention will become apparent when considered with the following specification and accompanying drawings wherein:

FIG. 1 is a perspective view of an inflatable catamaran incorporating the inventions, FIG. 2*a* is a front elevational view showing the mast (portion) in its stepped position, FIG. 2*b* illustrates a portion of the mast, sail and "D" rings on the mast.

FIG. 4*c* illustrates the mast stepping "T" in its latched position for car topping purposes.

FIG. 5 is a perspective view of a portion of the central sub-frame assembly illustrating the telescoping thereinto of the tubular side frame members and the construction of the semi-circular or arch bracket for receiving an inflated hull, FIG. 6 illustrates the lateral end of one of the fore and aft sub-assemblies with a tubular frame member being inserted telescopically therein, also showing alignment pin notch in structure for locating in holes (if castings are used, this structure would be a balanced T), FIG. 11 illustrates the roller pillows for rolling the boat to the water as well as providing bolster support to riders at back of boat.

DETAILED DESCRIPTION OF THE INVENTION

Referring collectively to FIGS. 1 to 4, an inflatable catamaran 10 includes a mast 11 which, in this embodiment, is comprised of four tubular sections 11-1, 11-2, 11-3 and 11-4 which are made from three inch round aluminum tube, each (one is 8', others are each 6½' plus slip fittings of 1½' each) measuring no more than about eight foot in length. Connecting sections 11-C are approximately thirty-six inches long thereby overlapping or telescoping into the next succeeding section by about eighteen inches. These are intended to be simple slip fits using shims 11CS which are secured in place by pop rivots (not shown) to reduce the free play to minimum tolerances. Alignment is determined by lining up the "D" rings 11D (FIG. 2*b*) that are mounted on the mast, and is superior to most currently used mast constructions in that it eliminates the need for special castings, extra inventory, and considerably reduces the weight for the user. Each mast section may be sealed or include foam flotation to avoid loss in case of tipping of the boat. As illustrated in FIG. 4*a*, the insert for each mast section come from the top section and go into the bottom section. The upper mast section 11-4 has a cap member 11-CM at the top and has three two and three quarter inch D-rings 11R-1, 11R-2 and 11R-3 which are used to attach the rope stays sets 12-1, 12-2, 12-3, 12-4, 12-5 and 12-6 which partially locate the mast. Note that rope stay sets 12-3, 12-4, and 12-2, 12-1 extend to rope guide D-rings 13-1 and 13-2 on the forward tips or ends of longitudinal members 61 and 62, respectively.

Figure 3:
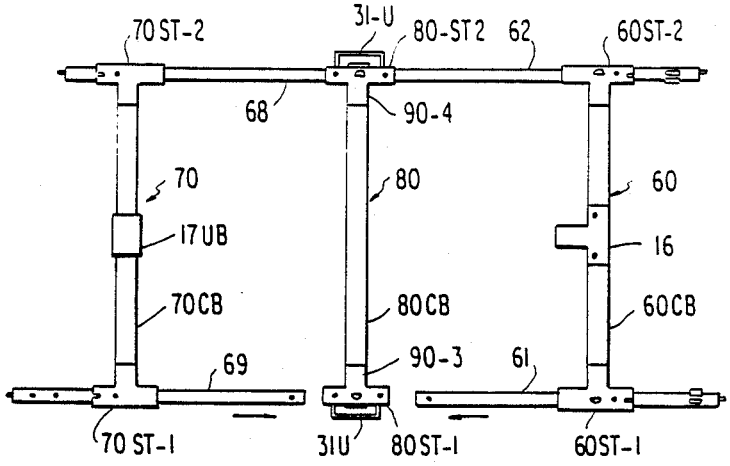
FIG. 3 illustrates the deck framing and its three main sub-assemblies.
Figure 4A:
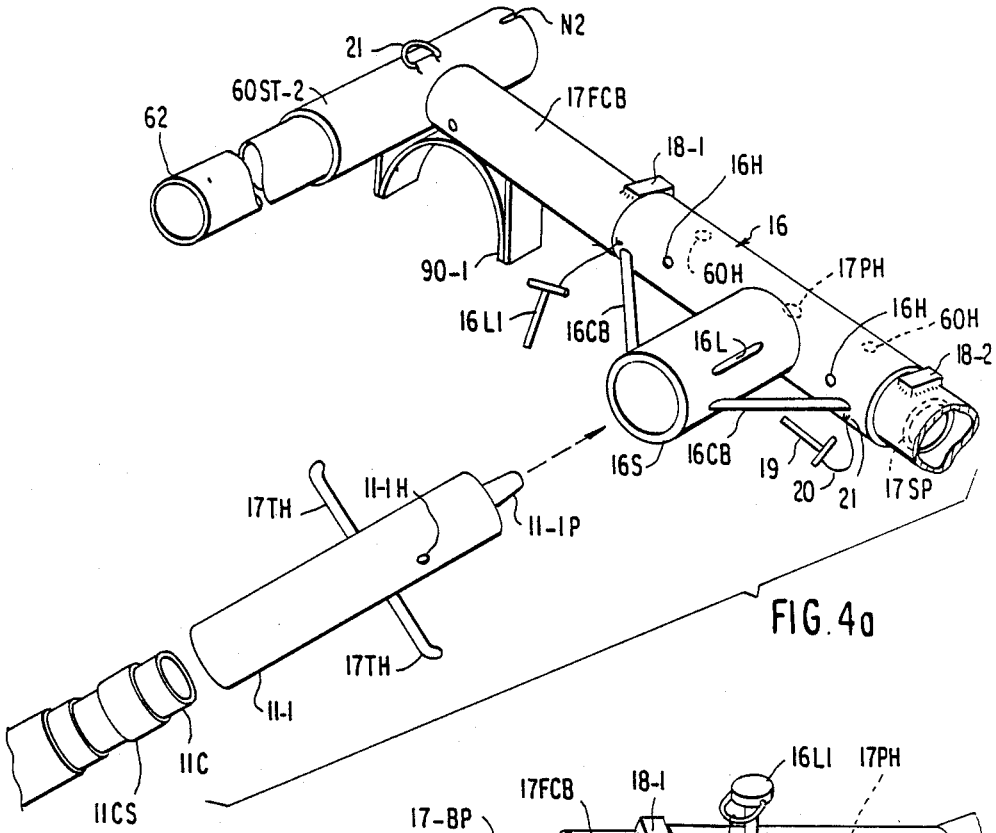
FIG. 4*a* is a partial isometric view illustrating a portion of the forward sub-frame assembly including the mast stepping arrangement and a portion of the mast showing its telescoping construction.
Figure 4B:
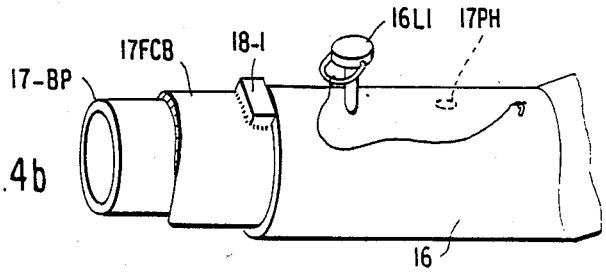
FIG. 4*b* is an enlarged view of a portion of the mast stepping arrangement showing the inner strengthening cylinder and stepping "T" stop collar.
Figure 7A:
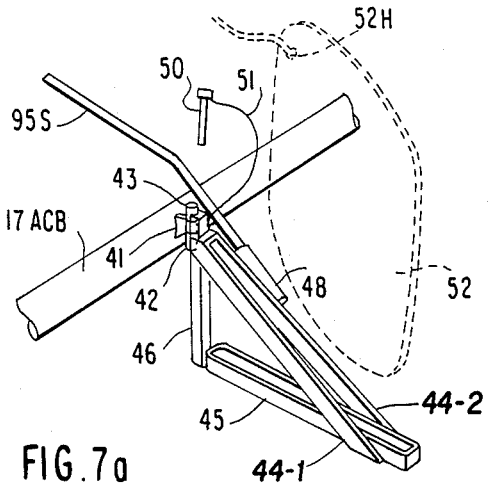
FIG. 7*a* is an isometric view of the rudder frame assembly showing in dotted section the position and insertion of the rudder blade.

The mast stepping construction is illustrated in FIGS. 4*a*, 4*b* and 4*c* and includes a T-shaped member 16 which is rotatably mounted on forward cross bar member 17FCB and located in position by stop collars 18-1 and 18-2, stop collar 18-2. The leg or stem 16-S of the T-shaped mast stepping unit 16 has a pair of elongated slots 16L (only one shown in FIG. 4*a*). The lower mast section 11L-1 has a downwardly extending pin 11-1P and a transverse hole 11-1H which may include a cylindrical tube or bearing member (not shown). When the lower end of the mast section 11-1 is inserted into the stem 16-S, a pivot pin 19, which is tethered by wire rope 20 by wire rope on stepping bracket 16 or can be mounted to 16CB, is passed through elongated slots 16-L and the bearing hole or pivot hole 11-1H. The lower pin 11-1P bears against the external surface of the forward cross bar 17FCB. When the mast 11, with the lower end in the stem 16-S, is rotated about the forward cross bar as its axis, pin 11-1P drops into a transverse pin hole 17-PH which accurately sets the angle of mast relative to the horizontal. In this case, hole 17-PH sets the mast angle at an angle of approximately 75 degrees. A pair of cross braces 16-CB are welded between the stem of the T and the cross of 16-T. An interior strengthening pipe 17-ISP has holes corresponding to the pin locating hole 17-PH. When the mast stepping pin 11-1P slides into the stepping hole 17-PH and the pivot pin 19 slides in slot 16L, the mast is stepped and is then further locked in position by a pair of locking pins 16L1 and 16L2 (which are tethered to stepping "T" 16 or to 16CB by wire rope) which pass through holes 16-H-1 and 16-H-2 which extend transversely through at least the stem of the T 16-T and the interior strengthening pipe 17-1SP. Rotating bracket 16 is 180 degrees and reinserting pins 16H-1 and 16H-2 position the mast stepping unit for car top position. After assembly of the mast, sections to the sail via its sleeve 27H, slid onto the mast. The mast, with the sail thereon, and rope stays 12-1 . . . 12-6 hanging loose, can be lifted by one person and pivotted so that it slides in the retaining cup 16-S with pin 11-1P sliding into hole 17-PH to thereby assure that the mast is properly aligned at the preferred angle (75 degrees) and temporarily located until pins 19 are inserted and mast stays 12-1 to 12-6 are adjusted in place when it is inserted into the cup. The bottom section of the mast has a transverse handle bar 17TH to assist the sailor gripping the mast to lift it up for unstepping purposes.

Figure 10:
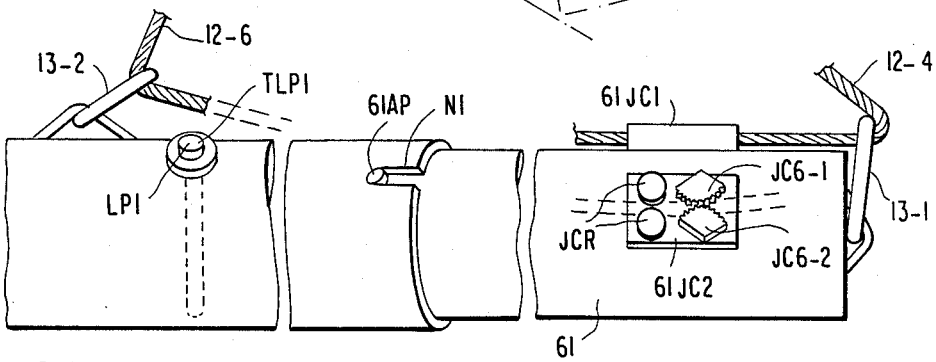
FIG. 10 is an enlarged isometric view of the forward end of the forward pairs of longitudinal frame assemblies showing the rope guides and jam cleats for adjusting the mast.

In addition to the mast stepping bracket described above, the mast is located by means of a series of two or three rope stays on each side of the mast. Rope is preferred in this embodiment so as to reduce weight and complexity as well as the cost of the boat and is a more friendly medium for the uninitiated sailor to work with. Rope stays 12-1 . . . 12-6 are attached to the mast at the upper two sections (with optional rope stays 12-5 and 12-6 attached to the second from the bottom section) into D-rings 11R (see FIG. 2*b*). FIG. 10 illustrates the forward end construction of the forward pair of longitudinally extending tubular frame members 61 and 62. Tube 61 has jam cleat assemblies 61JC-1 and 61JC-2 secured thereto. Jam cleats 61JC-1 and 61JC-2 include a pair of guide rollers JCR and opposing gripping members JCG-1, JCG-2, respectively, which are pivotally mounted on the frame of the jam cleat assembly. Rope is fed through rollers JCR and between grippers JCG-1 and JCG-2 to secure the top and pulled from between the grippers to release the rope. D-rings 13-1 and 13-2 serve as rope guides for rope stays 12-4 and 12-6.

As shown in FIGS. 3, 4*a*, 5, 6 and 10, the forward longitudinal frame members 61 and 62 telescoped through the tubular cross portion 60ST-1 and 60S-2, respectively, with alignment pins 61AP and 62AP aligned with slots or notches N1, N2, in the facing ends of the central sub-assembly T-shaped members 80ST-1 and 80ST-2, respectively, and locked in position by locking pins LP-1 and LP-2, which project through aligned hole pairs (not shown) in the longitudinal frame members 61 and 62 and the cross 80ST-1 and 80ST-2 of the T members on the lateral ends of the central subframe assembly 80. Locking pins LP-1, LP-2... are conventional and preferably of the type having a thumb release mechanism TLR-1, TLR-2 . . .

The rope stays are connected to the mast mounted D-rings via standard snap fasteners (not shown) to which the rope has been tied. These rope stays then thread through guide D-rings on leading edges and are threaded through the jam cleats mounted on tubes 61 and 62. A fourth set of stays (not shown) can run back to the sides of the center deck back for additional stability, if needed, and be attached to D-ring 21 such as shown in FIG. 5.

The sail, measuring 11'6"×25'6" and cut straight, is boomless and battenless in this preferred embodiment. While this does not allow the same degree of maneuverability of a fully battened and boomed sail, it does allow the casual sailor ease of use, simplicity and reduces the fear of sailing such a craft and it also drastically reduces the cost of the sail, as well as increasing ease of assembly and storage.

As shown in FIGS. 1 and **2*b*, the sail is attached to the mast via a full length sleeve or sock 27 which slips over the mast 11 and therefor eliminates extra hardware necessary for raising and lowering a sail, as well as eliminating the use of tracks that are normally part of the mast. The sail sock or sleeve has three holes 27H cut in it so that the rings 11-R-1, 11-R-2 and 11-R-3** are open or available for use.

As illustrated in FIG. 1, the sail is guided via a simple rope traveler 28 that is attached to two D-rings that are at each side of the rear most or aft sub-frame assembly to permit considerable sail movement and also to help the novice sailor move the sail in nearly a 180 degree arc to enable the novice better catch the wind. In addition, it is less expensive, lighter and more easily assembled than a hard mount system as used on most other catamarans. However, other techniques for guiding and controlling the sail may be used.

The sail is tied down to the forward deck section by means of a simple rope (not shown), a single gromet hole 29 at the aft section of the sail is used to attach conventional fiddle block and pulley FBP to rope traveler 28 and again, gives the novice sailor only one option and thereby eliminates confusion. The sail 25 can be multi-colored and can include any logo as desired. The sail in the preferred embodiment is thus functional in the simplest and least expensive to produce in quantity. However, it will be appreciated that some features of the invention can be used with more expensive sail rigs if desired.

The two inflatable hulls or pontoons 15-L and 15-R are identical and each is a mirror image front to rear and in this embodiment are eighteen feet long. This allows the novice sailor to put either tube on either side of the boat without any negative consequence. The main section of the boat, in this preferred embodiment, is twelve feet long and is entirely usable for the decking which is unique to this invention.

The three foot points 30-1 and 30-2 on either end are used to ensure a smooth access path of the main hull into and through the water and to provide extra storage space for miscellaneous items that will be placed in the netting described below, placed between the pontoons.

The tubes 15L and 15R are twenty inches in diameter, and are reinforced with extra fabric wherever metal bracing touches the tube so as to prevent extra wear or abrasion. Similar rub strips also run the full length of the bottom of the boat to prevent damage while running the boat onto land or over the beach. Similar full length rib strip is also on the top of the tube to add structural strength. The front and rear point of the tubes are eight and one-quarter inches in diameter to enable the tube to have as much rigidity as possible to keep a relatively sharp edge to the water with minimal flexing.

Three chambers per side are used to ensure a great degree of safety. Although two chambers per side might also be used. In effect, the full tubes will require over 5000 pounds to submerge them, and each tube section, the end sections are less due to points —ends hold about 500–600 lbs. max, should the other five be damaged, will hold about 800 lbs. at water line. This is the equivalent of five to six adults who can stay afloat if five sixths of the boat is destroyed. Most catamarans that are used for simple day sailing carry two adults with an occasional outing with four adults. The tubes 15 are also quite comfortable as seats (through the trampoline) or pillows.

Hypalon, nylon and rubber are the primary materials used in the 30 oz. fabric while other fabrics and weights may be substituted as available. Valves are military specification and the mounted D-rings used to hold the mast stays are 3000 lb. test with a diameter of 2.75". The rings are much stronger than mounts. Mounts or stepping probably is only good for 1000 lbs. The D-rings are used to hold the "catch all" storage netting that is stretched between the two tubes in the front three feet of the boat or this net may be attached directly to the forward longitudinal tube sections. This net is described later. All D-rings are double strengthened so that the boat can be towed, lifted or dragged by a combination of any two rings.

The frame is comprised of three major sub-frame assemblies: The forward sub-frame assembly 60, an aft sub-frame assembly 70, and a central sub-frame assembly 80 (FIG. 9 and FIG. 3) which are joined by longitudinally extending tubular members 61, 62, 68 and 69.

The longitudinally extending tubular members for the deck are slid or telescoped through the open end sections of the sub-frame assemblies and aligned and pinned or otherwise releasably secured thereto. This alloys easy assembly for the side pipes or longitudinal tubes, upon which the trampoline sleeves TS-1, TS-2, TS-3 and TS-4 are slid. These side deck pipes are made of 2.75" aluminum tube and each are 7' long in the rear (68, 69) and 8' long in front (61, 62). (For simplicity, all longitudinal tubes may be 8' long.) The extra length at the rear makes it easier to push the longitudinal tube into the welded tubes and through the trampoline decking. The forward longitudinal tubes 61 and 62 are each 2' longer than the main deck for the same purpose as the rear and to hold rope stay guide D-rings 13 and jam cleats JC for attaching the rope mast stays to a solid structure, as described earlier. Each side tube is held in place by two releasable locking pins as described above, one in each sub-frame assembly. Each sub-assembly 60ST-1, 60ST-2, 70ST-1, 70ST-2, 80ST-1 and 80ST-2 has relatively long sections of three inch tubing welded to the ends of cross bars 60CB, 70CB and 80CB.

This length provides center bracing for each of the four side tubes 61, 62, 68 and 69 and a backing plate for the daggerboard mounting bracket 31.

A typical corner assembly is illustrated in FIGS. 4 and 6 and a typical side assembly is illustrated in FIG. 5.

At the outer extreme edge of the three cross-sections both sides are large D-rings 21 which are mounted via metal strip and rivets or otherwise welded as indicated at 21 in FIGS. 5 and 6. These D-rings are used to hold the mast stays, sail trailers or other items and may be added where necessary or desired.

Figure 9:
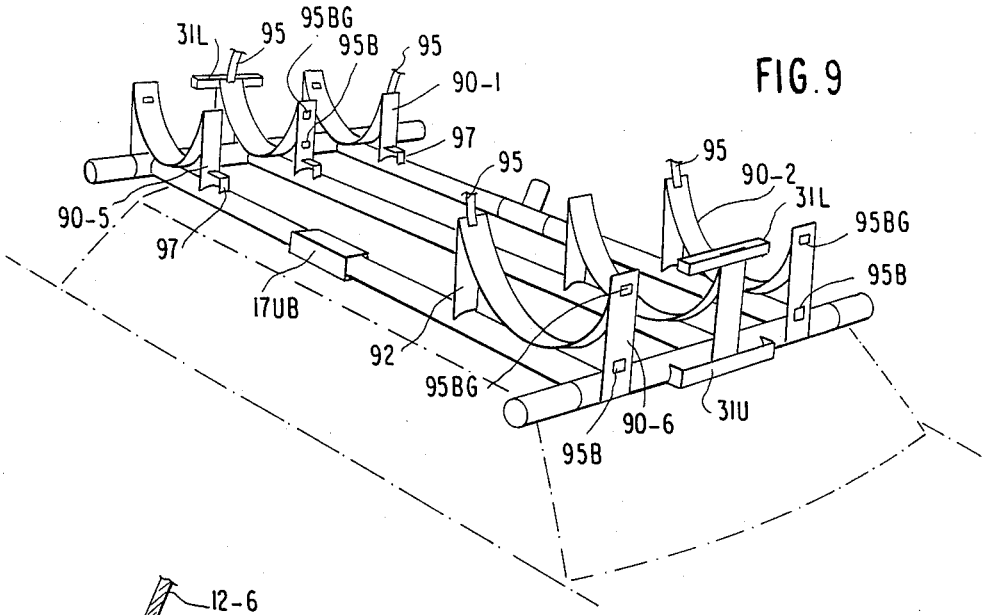
FIG. 9 illustrates the preferred collapsed form of the frame for car topping purposes.

At the lateral sides of each sub-frame assembly and below the surfaces of the cross braces 60CB, 70CB and 80CB, and pipe coupling end member 60ST, 70ST and 80ST are welded semi-circular or arched brackets 90-1, 90-2, 90-3, 90-4, 90-5 and 90-6 for reeiving and securing hulls or pontoons 15L and 15R, respectively which in this embodiment are inflatable. They have a shape which is complementary to the upper hull portion. Each of these curved or arched mounting brackets are identical and surround exactly one-half of the circumference of each tube. These are constructed of four inch plate aluminum straps and have vertical legs 91 and 92 (see FIG. 5 and 9) and semi-circular or arched portion 93. The leg portion 91 is welded at its side to the tubular sockets 60ST, 70ST and 80ST as illustrated in FIGS. 5 and 9. Each of the straight legs 92 has the end thereof circularly shaped so as to conform to the shape of the cross bar and is welded thereto. The semi-circular strap portion 93 is also welded to the cross bar at the point tangency thereto. Each of the straps has four slits 94 cut in them through which webbing material 95 is threaded to engage buckle 95B so as to secure the inflatable hulls or buckles to the sub-frame assemblies. Buckles 95B are secured on the inside vertical leg of the semicircular brackets on the central sub-assemblies and the belting or webbing 95 is threaded through a slot on the opposite side arch. The reverse is done with all remaining belting 95 and buckles: the buckles 95B are secured to the outer vertical legs of the semicircular brackets 90 and the belting 95 is passed through one of the slots in the arch. Belt guides 95BG are used to retain the belts in position on the arched brackets. This method guarantees correct assembly of all components since no assembly by the user is required. The mounting points on the inflatable tubes are identified by the location of rub strips 96 located on the pontoons and shown in connection with FIG. 1. The webbing 95 that holds the aluminum mounting straps to the pontoons is standard two inch dive belt strap and each end is connected to the other via a standard dive belt buckle 95-B. It will be appreciated that other ways of attaching the pontoons to the bracket can easily be devised. For example, the buckle can be secured to leg portion 91 or 92 and one end of the webbing secured through one of the elongated slots so that the semi-circular portion 93 encircles one half of the pontoon and the webbing encircles the remaining half. Either configuration (as well as many others such as a hinged, semi-circular flexible and adjustable clamp (not shown)) is suitable and will allow the purchaser to adjust the tightness of the belts when sailing since the water temperature frequently can reduce the size of the tubes due to cooling of the air in the tubing. These adjustments can be made from the deck without getting wet.

Figure 7B:
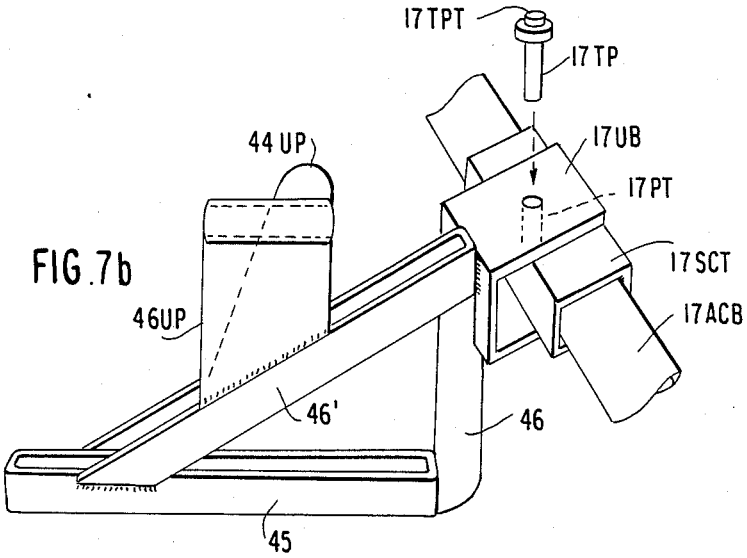
FIG. 7*b* illustrates a preferred modification of the connection of the tiller bar to the rudder frame assembly and rudder guideway and can be used for mounting a small motor.
Figure 7C:
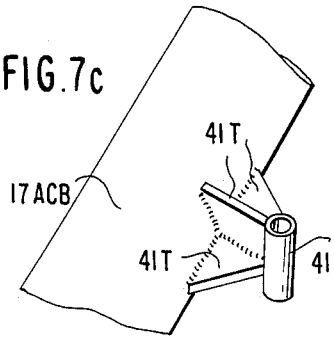
FIG. 7*c* illustrates a rudder frame pivot cylinder as secured to the aft cross bar sub-assembly.

The trampoline shown in FIG. 1 is composed of three different sections, two of which are of the exact same size but of different materials. The forward most trampoline 100F extending between hull portions 30-1 and 30-2 is made of light duty cargo netting and extends from the forward most deck member 60-CB to within six inches from the front of the boat and is connected to the deck member via a rope 101 that is wound around the deck tube 60-CB and through gromets located in the cargo net. It also mounts in two other locations to the D-rings 13-1 and 13-2 on each pontoon 15-L and 15-R. The D-rings on the pontoons are mounted by dive belt webbing and dive belt clamps that are described above in connection with the deck mounting section. Optional mounting locations would include the extentions of longitudinal side tubes 61 and 62 depending on the amount of slack the owner desires. This storage area allows the user to carry the oars, coolers and other useful items as may be desired thus leaving the deck area useful for sunning. Similar net is optional at the rear most section of the boat behind cross member 20 but with modification to allow the rudder and it smount (FIG. 7*b*) to turn without binding in the net.

The trampoline section 90F between the forward and middle sub-frame assembly supports is made of a tight but not water-proof netting. This allows the user a section where water can drift through and where air circulation is made possible. The front and rear of this trampoline section is tied as at 90X onto the corresponding aft-section of the deck using nylon or other type of type. Holes 60CBH, 70CBH and 80CBH in the cross-bar assemblies serve as the points for the trampoline roping. Adjustments are made by tightening the rope and reknotting it. The sides of the trampoline are mounted onto the side tubes 61 and 62 via a sock or sleeve TS-1, TS-2 through which the side tubes are slid. This trampoline portion has one D-ring mounted on each side of the sleeve for connecting roller pillows P (FIG. 11) thereto. The roller pillows are shown in FIG. 1 and are about 10 inches in diameter and outer 24 or 36 inches long. These are used for placing under the pontoons so that the boat may be rolled to the water. In addition, these inflatable tubes will serve as bolsters for the rear most side and back sections of the boat. And, as noted above, they may be attached to D-rings or to ropes that hold onto the trampoline and will serve as back rests for the casual boater on each side of the boat near the tiller. These pillows are color coordinated and are made out of 24 ounce material and have less expensive, but similar in nature and function, valves as the larger pontoons. When not being used, these pillows may be stored, either inflated or deflated in the front storage netting 100F.

The rear or aft mast section 90-A of the trampoline is exactly the same as the forward section 90-F except that it is made of a water proofed material, such as a rubber impregnated fabric, or a heavy gauge plastic, nylon webbing. Using two different fabrics allows two different environments on the boat: dry cruising and a wetter dive platform. It allows swimmers to drip dry on the front section 90-F with the water going through the tarp before they move to the dry back section 90-A. The water-proofed portion, and the air flow sections can be easily reverssed so that on hot days, the air flow materials is aft and, on cold days, the warmer water-proof section can be aft.

The daggerboards 30 and rudder 52 are identical to each other (and of a design well known in the art) and hence can be interchangably used in both places. Thus, should the sailor break one or lose one, the boat is still sailable and can be safely returned because of the rudder-daggerboard interchangeability feature.

Figure 8:
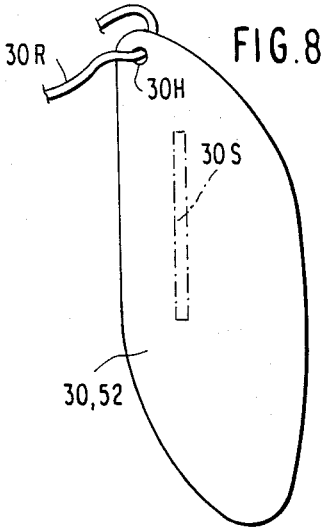
FIG. 8 illustrates a typical rudder and daggerboard construction as incorporated in the invention.

The daggerboards 30 are supported by aluminum pocket-like brackets 31U and 31L which are welded to the lateral tubular end pieces 80ST-1 and 80ST-2, the upper bracket 31U being a 5" wide strip which has 3" holes in the ends thereof which is slid over the tubular end pieces 80ST-1 and 80ST-2 and welded in place. Optional brackets can be made from tightly tied bungi cords that are wrapped around the T-bracket 80ST-1. A rope or shock cord tether is inserted through D-ring on the forward trampoline. This allows the daggerboards 30 to be vertically slid down from the deck into the water and to be raised and locked in an up position due to the tension on the cord forcing the daggerboard into a slightly cocked position in the slip bracket 31. Thus, the sailor has a very simple method of inserting the boards and raising them when the need arises. A rope tied through the daggerboard 30R tied through hole in daggerboard 31H prevents the board from stepping through bracket 31. The plate 91 provides lateral support for the daggerboards. When the board is up it can be held elevated by a shock or bungee cord (not shown). In FIG. 8 the daggerboard is shown with a dotted slot 30S through which may pass a threaded shaft (not shown) having locking knob on the end thereof and threadably engaged with a threaded bore hole 30B in the upper end of vertical plate 91 above arched member 93. This is an optional method of mounting the board.

Rudder 52 is carried in a rudder frame assembly RFA, two embodiments of which are shown in FIGS. *7a* and *7b*, which is pivotally mounted on the aft cross bar 17ACB. In the preferred embodiment of FIG. *7b*, a square tube 17SCT is welded to aft cross-bar 17ACB. A pivot tube 17PT or bearing element is secured in a vertical bore extending transversely of cross-bar 17ACB and square tube 17SCT. A "U"-shaped bracket 17UB having aligned holes therein receives a rudder pin 17TP which has a thumb operated release 17TPT. The legs 17UB-1 and 17UB-2 are of sufficient lengths to allow about 180 degrees rotation thereof.

As shown in FIG. *7c*, a pivot cylinder or tube 41 is weldably secured to cross bar 17 ACB by triangular brace members 41T (a fourth brace member is on the underside and not shown in FIG. *7c*). Since there is a large force acting on the rudder, the pivot tube must be very securely mounted on the aft cross-bar 17ACB. Vertical bar 46 has a pair of spaced pivot tubes or cylinders 42 and 43 welded thereto form, when aligned, a rudder pivot assembly with tube 41 when pivot pin 50 is passed through the aligned pivot tubes 41, 42 and 43. A rectangular loop 45 is welded or otherwise secured to the lower end of verical bar 46 and an angulated U-shaped bracket 44-1 and 44-2 has the base thereof welded or otherwise secured to the upper end of vertical bar 46 and the lower ends of legs 44-1 and 44-2 welded or otherwise secured proximate the outer end of rectangular loop 45. A tiller bar socket 48 is welded to leg 44-2 of the U-shaped bracket and receives a tiller arm 49 which may have an extension thereon. In the preferred embodiment shown in FIG. 7b, a vertical plate 46VP is secured to leg 46 of the U-shaped bracket so that the tiller bar can be inserted. A vertically extending plate 44VP is secured to leg 44 of the U-shaped bracket. Plates 44VP and 46VP are also used to hold rudder 52 in position via rope 30R which is tied through hole 52H and to keep rudder from sliding down 46.

FIG. 1 shows the tiller bar 95 configuration and its insertion into tiller bar socket 48. A rope guide 96 is fastened to the short length of tiller bar through which the sail rope is threaded. The longer tiller bar is attached to the shorter one via a U-shaped bracket to allow approximately 160 degrees of motion between the bars. The long bar 95L is attached to the short bar 95S via a shear pin 96 which is inserted through the U-bracket and into the short tiller bar. The length of the tiller bars are so designed as to allow the boat to be steered from the center of the boat or any location to the rear of the center (e.g. part 80). The rear tiller bar when inserted into tiller bar socket 48 can be either a force fit or attachment can be optionally, by shear pin.

Both tiller bars become support members of the roof rack and are inserted into socket brackets 97 located on 90-1, 90-2, 90-5, 90-6 (see FIG. 9). These are used to support the 8' and 7' lengths of tubes used for the mast and longitudinal side tubes (61, 62, 68, 69, 11-1, 11-2, 11-3, 11-4).

Jam cleats 98 are used on the longer bar to affix the sail rope and ease the strain on the novice sailor while sailing. The end of the long tiller bar 95L may have a foam slip handle to provide a firm grip for the sailor.

Figure 12B:
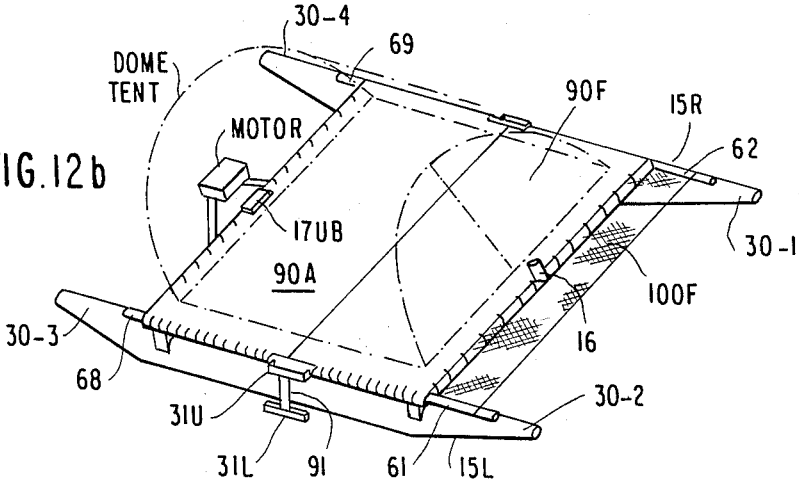
FIG. 12*a* illustrates a catamaran incorporating the invention wherein a pyramid tent is supported from a portion of the mast, the corners of the tent being secured to D-rings on the rectangular frame, and, FIG. 12*b* indicates a dome type tent on the trampolline and a motor mounted on the aft cross-bar.
Figure 12A:
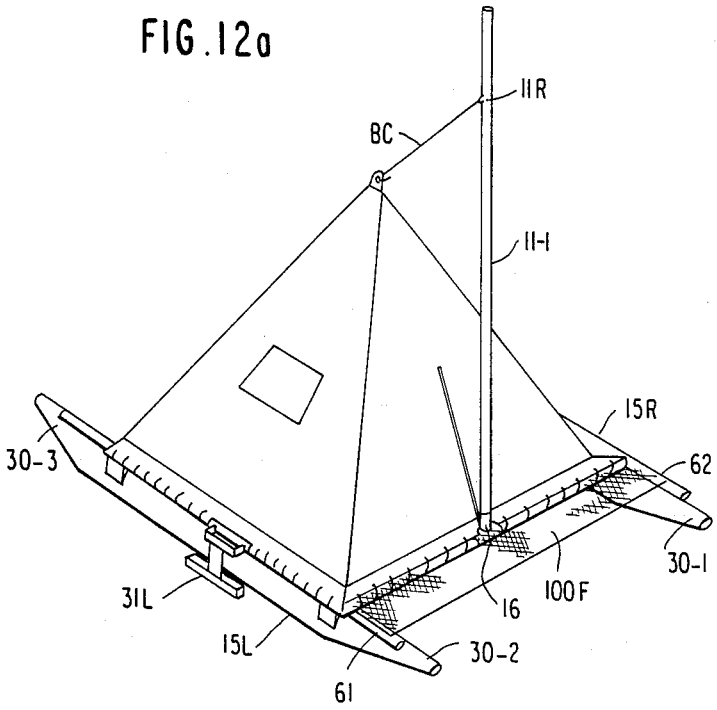

As shown in FIGS. 12*a* and 12*b*, the invention can also serve as a sun deck, pontoon boat, and be a self-contained camping facility for recreational or commercial purposes.

As many different embodiments of the invention will be obvious to those skilled in the art, some of which have been disclosed or referred to herein, it is to be understood that the specific embodiments of the invention as presented herein are intended to be by way of illustration only and are not limiting on the invention, and it is to be understood that such embodiments, changes, or modificatons may be made without departing from the spirit and scope of the invention as set forth in the claims appended hereto.

What is claimed is:

1. In a catamaran having a rectangular collapsible frame for securing a pair of hulls in spaced relation, and a trampoline on said frame, the improvement comprising:

said collapsible frame including fore, aft and central sub-frame assemblies, and a first pair of longitudinally extending tubular members extending between said fore and central sub-frame assemblies and a second pair of longitudinally extending tubular members extending between said aft and said central sub-frame assemblies, each said sub-frame assembly including a cross-bar, a pair of laterally spaced semi-circular hull embracing brackets secured beneath said cross-bar, flexible strap means for securing said hulls in said semi-circular brackets, a pair of tubular end pieces for telescopically receiving one end of said longitudinally extending tubular members, respectively, said tubular end pieces being secured at a 90 degree angle to the lateral ends of said cross-bar, and locking means operative between each said longitudinally extending tubular members and tubular end pieces.

2. The catamaran defined in claim 1 wherein the pair of tubular end pieces on said central cross-bar sub-frame is telescopically received on said longitudinally extending tubular members and toward the ends thereof, respectively, with the end pieces of said fore and aft cross-bar sub-frame telescopically received on the same pair of longitudinally extending tubular members to constitute a collapsed frame such that said collapsed frame can be inverted and mounted on a car top with said semi-circular hull encompassing brackets aligned transversely of said car to serve as carrier for deflated hulls, trampoline and sail.

3. The catamaran defined in claim 1 wherein said fore sub-frame includes a mast stepping member rotatably mounted on said fore cross-bar at a predetermined location, a mast locating hole located at a predetermined angular position on said fore cross-bar and a pin member secured to the lower end of the mast and coaxial therewith, projecting into said mast locating hole when said mast stepping member is rotated to said predetermined angular position.

4. The catamaran defined in claim 1 wherein said trampoline has two lateral sides and fore and aft ends and includes fore and aft lace means for securing said fore and aft ends of said trampoline to said fore and aft cross-bars, respectively, and lateral lace means for securing said lateral sides of said trampoline, respectively, to said longitudinally extending members.

5. The invention defined in claim 3 including means defining a pair of alignable holes in said mast stepping member and said fore cross bar which are aligned at said predetermined angular position and on a further pin member manually inserted therethrough.

6. The catamaran defined in claim 1 including a rudder pivot means and means for securing side rudder pivot means to said aft sub-frame cross-bar.

7. In a sail boat having a mast, and a mast stepping construction wherein the mast is moved first manually on an arc about an axis transverse to the longitudinal axis of the sail boat to a predetermined angular position and then in part by gravity axially while at said angular position to lock said mast in said angular position, a pair of hand bars extending laterally outwardly from a position near the base of said mast to permit easy axial lifting of said mast to unlock same and allow pivoting of said mast by gravity about said axis transverse to the longitudinal axis.

8. In a catamaran having a rectangular collapsible frame for securing a pair of hulls in spaced relation, and a trampoline on said frame, the improvement comprising:

said collapsible frame including fore, aft and central sub-frame assemblies, and a first pair of longitudinally extending tubular members extending between said fore and central sub-frame assemblies and a second pair of longitudinally extending tubular members extending between said aft and said central sub-frame assemblies, each said sub-frame assembly including a cross-bar, a pair of laterally spaced semi-circular hull embracing brackets secured beneath said cross-bar, flexible strap means for securing said hulls in said semi-circular brackets, a pair of tubular end pieces for telescopically receiving one end of said longitudinally extending tubular members, respectively, said tubular end pieces being secured at a 90 degree angle to the lateral ends of said cross-bar, and locking means operative between each said longitudinally extending tubular members and tubular end pieces and a rectangular tube member secured to said aft cross-bar.

9. The catamaran defined in claim 8 including a rubber bearing pivot means extending through said rectangular tube member and said aft sub-frame cross-bar.

10. The catamaran defined in claim 9 including a rudder frame assembly, a rudder clevis secured to said rudder frame assembly, a pair of aligned rudder pivot holes in said clevis, said aligned holes being aligned with said rudder bearing pivot means and a rudder pivot passing through said rudder pivot holes and rudder bearing pivot means.

11. In a catamaran having a pair of inflatable tubular hulls, a rectangular frame for securely maintaining said inflatable tubular hulls in spaced apart relation when inflated, said rectangular frame having lateral side bars and fore and aft cross bars, a mast and mast stays therefor, a sail carried by said mast, a trampoline deck secured to said rectangular frame, daggerboard and rudder assemblies for control, the improvement comprising:

mast stepping means including a mast pin at the base of said mast, a cup bracket rotatably mounted on said forward cross bar, said cup bracket, including a pair of hollow tubular members secured in the form of a "T" with the stem of said "T" receiving the base of said mast, said cup bracket having an elongated slot in each side of the stem of said "T" for receiving a mast pivot pin, a mast stepping aperture in said forward cross bar at a predetermined angular position, and the cross of said "T" telescoped on said forward cross bar whereby when said mast is pivoted on said pivot pin to a predetermined angular position, it slides axially downward into said cup bracket and said mast pin projects into said mast stepping aperture.

12. The catamaran as defined in claim 11 wherein said mast stays include a pair of non-metallic ropes on a rope guide secured to each side of said frame, at the forward ends thereof, respectively, and a jam cleat aligned with said rope guides through which the ends of said rope stays pass to provide quick adjustability of the tension in said rope stays.

13. The catamaran as defined in claim 11 wherein said inflatable hulls have sections which extend fore and aft of said rectangular frame as as to insure a smooth access pass of main hull portions into and through the water.

14. The catamaran as defined in claim 11 wherein there are a pair of daggerboards, a vertical guide means for said daggerboards secured to a central section of said catamaran and a single rudder, a vertical guide frame for said single rudder, said single rudder and daggerboard units being identical so that should one daggerboard or single rudder be lost, the catamaran is still sailable and can be returned safely because of this interchangeability of said single rudder and daggerboard units.

15. In a rectangular frame for a catamaran having a pair of hulls, and a trampoline, the improvement comprising:

said frame being collapsible and including fore and aft cross-bar sub-frames and a pair of longitudinally extending tubular members extending between said fore cross-bar and aft cross-bar sub-frames, each said sub-frame including a cross-bar, a pair of laterally spaced hull encompassing semi-circular brackets secured beneath said cross-bar, flexible strap means for securing said hulls in said semi-circular brackets, a pair of tubular end pieces for telescopically receiving one end each of said longitudinally extending tubular members, respectively, said tubular end pieces being at a 90 degree angle to the lateral ends of said cross-bar, said trampoline having fore and aft and lateral lace means for securing said trampoline to said fore and aft cross-bars and said pair of longitudinally extending tubular members.

16. The rectangular frame defined in claim 15 including means for mounting a shelter thereon.

17. The rectangular frame defined in claim 15, a further pair of tubular members wherein the tubular end pieces on said sub-frame are telescopically received on said further pair of tubular members, with the end pieces of said fore and aft cross-bar sub-frames being telescopically received on said further pair of tubular members to constitute a collapsed frame such that said collapsed frame can be inverted and mounted on a car top with said hull encompassing brackets aligned transversely of said car to serve as carrier for deflated hulls and sail.

18. The rectangular frame defined in claim 15 wherein said fore sub-frame includes a mast stepping member rotatably mounted on said fore cross-bar at a predetermined location, a mast locating hole located at a predetermined angular position on said fore cross-bar and a pin member projecting coaxially from said mast into said mast locating hole when said mast stepping member is rotated to said predetermined angular position.

19. The rectangular frame defined in claim 18 wherein said pin member is on the lower end of said mast.

20. The rectangular frame defined in claim 18 including means defining a pair of alignable holes in said mast stepping member and said fore cross-bar at said predetermined angular position and on a further pin member manually inserted therethrough.

21. The rectangular frame defined in claim 15 wherein the cross-bar on said fore sub-frame includes:

mast stepping means including a cup bracket rotatably mounted on said fore cross-bar on said fore sub-frame, said cup bracket including a pair of side members, an elongated slot in each side member for receiving a mast pin, whereby when said mast is pivotted from an aftward to a predetermined angular position, said mast slides axially downward into said cup bracket and said mast pin slides in said slots.

22. The rectangular frame defined in claim 15 wherein said aft cross-bar includes means for mounting a motor thereon.

23. The rectangular frame defined in claim 15 including a rudder pivot means and means for securing said rudder pivot means to said aft cross-bar sub-frame.

* * * * *

UNITED STATES PATENT AND TRADEMARK OFFICE

CERTIFICATE OF CORRECTION

PATENT NO. : 4,766,830

DATED : August 30, 1988

INVENTOR(S) : Daniel Kunz

It is certified that error appears in the above-identified patent and that said Letters Patent is hereby corrected as shown below:

Column 11, line 55, "rubber" should read --rudder--.

Signed and Sealed this

Twenty-eighth Day of March, 1989

*Attest:*

DONALD J. QUIGG

*Attesting Officer*

*Commissioner of Patents and Trademarks*